US005253014A

United States Patent [19]

Matsumoto

[11] Patent Number: 5,253,014

[45] Date of Patent: Oct. 12, 1993

[54] IMAGE FORMING APPARATUS INCLUDING A CONTROLLER FOR CONTROLLING IMAGE FORMING CONDITIONS IN ACCORDANCE WITH NORMALIZED DIFFERENCES IN DETECTED DENSITIES

[75] Inventor: Hiroshi Matsumoto, Fujisawa, Japan

[73] Assignee: Kabushiki Kaisha Toshiba, Kawasaki, Japan

[21] Appl. No.: 711,098

[22] Filed: Jun. 6, 1991

[30] Foreign Application Priority Data

Jun. 8, 1990 [JP] Japan ..... 2-148481

[51] Int. Cl.[5] ..... G03G 15/00

[52] U.S. Cl. ..... 355/208; 355/214

[58] Field of Search ..... 355/204, 214, 246, 233, 355/208, 228, 67, 68, 69

[56] References Cited

U.S. PATENT DOCUMENTS

| | | | |
|---|---|---|---|
| 4,662,738 | 5/1987 | Kasuya | 355/208 |
| 4,707,114 | 11/1987 | Aoki | 355/214 X |
| 4,839,696 | 6/1989 | Ohtani | 355/214 X |
| 4,879,576 | 11/1989 | Naito | 355/214 |
| 4,894,685 | 1/1990 | Shoji | 355/204 X |
| 4,958,189 | 9/1990 | Yoshida | 355/233 X |
| 4,967,211 | 10/1990 | Colby et al. | 355/214 X |
| 4,970,556 | 11/1990 | Iwata | 355/214 |
| 4,982,232 | 1/1991 | Naito | 355/69 X |
| 5,029,314 | 7/1991 | Katsumi et al. | 355/204 X |

*Primary Examiner*—A. T. Grimley
*Assistant Examiner*—Robert Beatty
*Attorney, Agent, or Firm*—Foley & Lardner

[57] ABSTRACT

An image forming apparatus has an illumination lamp and a controller for varying the intensity of light rays from the illumination lamp in accordance with a first base density area and a second image density area. The first density will be determined in accordance with detected values of highest and lowest degrees of brightness and highest and lowest degrees of darkness. Similarly, the second density will be determined in accordance with detected values of highest and lowest degrees of brightness and highest and lowest degrees of darkness. Differences between these values will be determined and then normalized. A conformity-determining section will find a voltage-controlling rule most similar to the normalized differences and the rule will be used to control the illumination lamp.

7 Claims, 10 Drawing Sheets

ω4⇒?

ω3⇒?

ω6⇒?

IMAGE FORMING APPARATUS INCLUDING A CONTROLLER FOR CONTROLLING IMAGE FORMING CONDITIONS IN ACCORDANCE WITH NORMALIZED DIFFERENCES IN DETECTED DENSITIES

BACKGROUND OF THE INVENTION

1. Field of the Invention

This invention relates to an image forming apparatus, and more specifically to an electrostatic type copying machine having a photoconductor, and designed to copy an optical pattern image which is the information formed on an original, by forming on the photoconductor a latent image corresponding to the image, rendering the latent image visible, and electrostatically transferring the visible image from the photoconductor to a recording material.

2. Description of the Related Art

Most electrostatic type copying machines include a photoconductor, a developing mechanism, a material delivering mechanism, and a cleaning unit. A latent image of the optical pattern image of the object, e.g., the information printed on a document to be copied, is formed on the photoconductor. The developing mechanism supplies developer (generally known as "toner") to the photoconductor, thereby developing the latent image into a visible one. The material delivering mechanism supplies the recording material, such as a sheet of paper. The image is electrostatically transferred from the photoconductor to a recording material, to make a hard copy. The cleaning unit removes the residual developer from the photoconductor.

The electrostatic type copying machine further includes an illuminating device. This device applies light to the document, and the light is reflected from the document. The light reflected from the document defines an optical pattern corresponding to the image formed on the document. The optical pattern is supplied to the photoconductor, whereby a latent image is formed on the photoconductor. As has been described, the developing mechanism supplies developer to the photoconductor, thereby developing the latent image into a visible one. The visible image is put on recording material, whereby a hard copy of the image information is produced.

The optical density of the image, thus copied, depends on the intensity of the light which the illumination device applies to the document. In order to produce a hard copy which is as clear as possible, the intensity of the light is adjusted in accordance with two items of information. The first item is the optical density of the image formed on the document. The second item is the optical density of the document, i.e. background of the document (hereinafter referred to as "base density").

To copy the image having a low optical density, such as an image formed by a pencil on a document, a light beam having a relatively low intensity is applied to the document from the illuminating device. On the other hand, to copy the image formed on a document having a high base density, such as a page of newspaper, a light beam having a relatively high intensity is applied to the document from the illuminating device.

The base density of a document and the average optical density of the image formed on the document are detected before the copying operation is started. These densities are used to determine the best possible intensity for the light to be applied to the document. In other words, the intensity of the light is automatically adjusted to an optimal value in accordance with the base density of the document and the average optical density of the image formed on the document.

Thanks to the intensity of the document-illuminating light, thus adjusted, conventional copying machines can, indeed, produce a clearer copy of the image formed on a document. However, they cannot produce clear copies when the image formed on a document consists of various components, such as photographs, characters, and graphics, which greatly differ in their average optical densities. If the intensity of the document-illuminating light is adjusted to the base density of the document and also to the average optical density of one image component, another image component having a far lower density, such as a pencil sketch, will not be copied at all in the worst case. On the other hand, if the intensity of the light is adjusted to the average optical density of an image component of a low density, such as a pencil sketch drawn on a news paper page, the ground of the image copied will be too dark.

SUMMARY OF THE INVENTION

It is an object of this invention to provide an image forming apparatus which can produce a copied image having the best possible optical density.

It is another object of the invention to provide an image forming apparatus which can produce a copied image having the best possible optical density, even if the original image consists of two or more components having different optical densities.

According to an aspect of the present invention, there is provided an image forming apparatus comprising: means for reading an original image which an original has thereon, a first area of the original having a predetermined first bright and second dark density range and a second area having a predetermined first bright and second dark density range means for forming an image on an image bearing member in accordance with the original image read by the reading means; means for detecting a first density corresponding to the first area and a second density corresponding to the second area in the original image; first judging means for judging an operation condition in which the image forming means forms an image of the first area of the original, from the difference between the upper and lower limit of the first density ranges bright area and the difference between the upper and lower limit of the second density range's dark area second judging means for judging an operation condition in which the image forming means forms an image of the second area of the original, from the difference between the lower and upper limit of the first density range's bright area the difference between the lower and upper limit of the second density range's dark area determining means for determining an operating condition in which the image forming means is to be operated, from the operating condition judged by the first judging means and the operating condition judged by the second judging means; and means for controlling the image forming means in accordance with the operating condition determined by the determining means.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

An embodiment of the present invention will now be described, with reference to the accompanying drawings.

Figure 1:
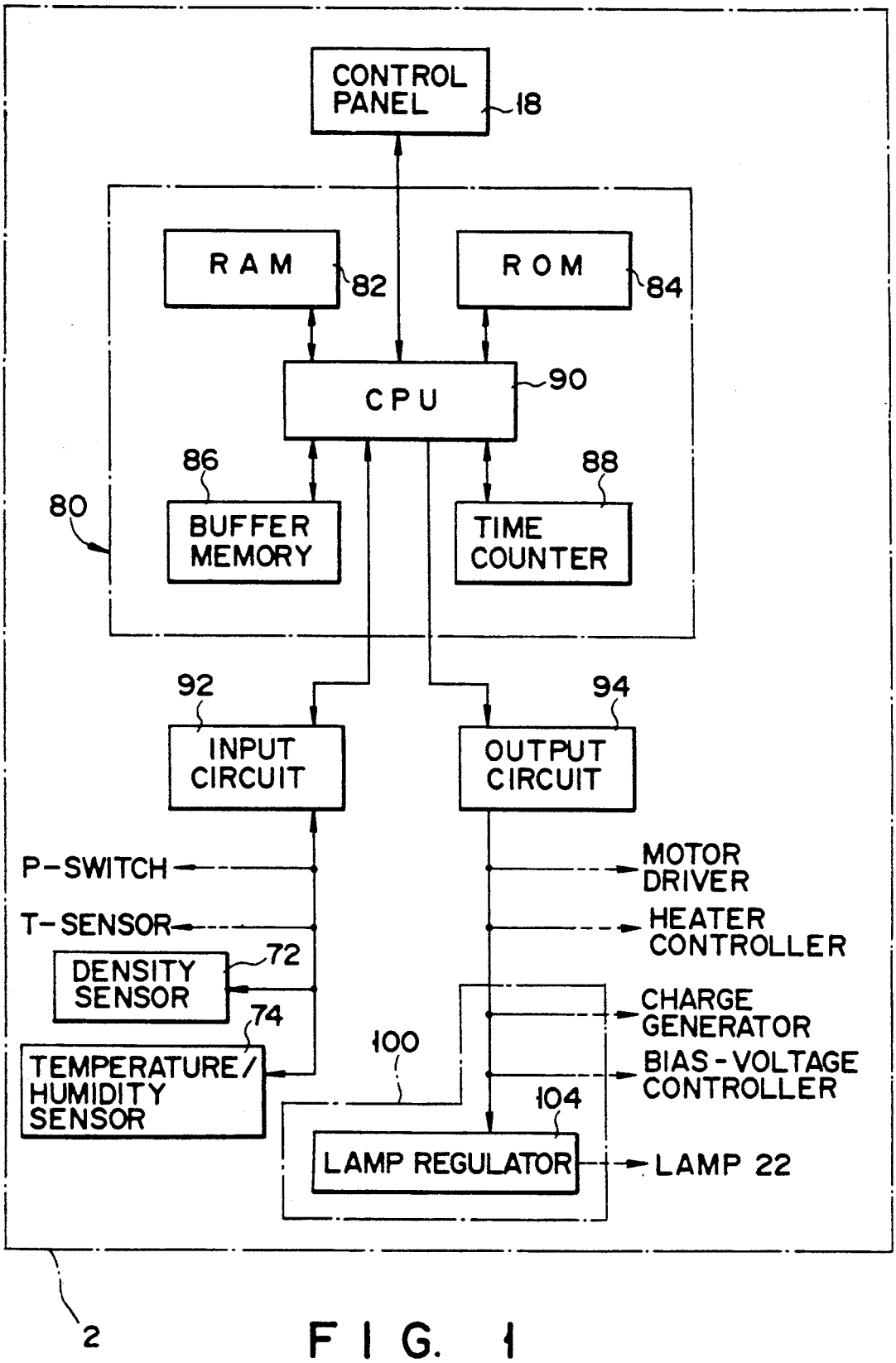
FIG. 1 is a block diagram schematically showing the electrical connection of the components of a copying machine according to the present invention.

FIG. 1 schematically illustrates a copying machine 2 according to the present invention. As is shown in FIG. 1, the copying machine includes a control panel 18, a density sensor 72, a temperature/humidity sensor 74, a control unit 80, an input circuit 92, an output circuit 94, and a condition-optimizing circuit 100. The control unit 80 includes a RAM 82, a ROM 84, a buffer memory 86, a continously-operating time counter 88, and a CPU 90.

The CPU 90 is a microprocessor connected to the RAM 82, the ROM 84, the buffer memory 86, and the time counter 88. The CPU 90 controls the components of the machine 2, other than the control unit 80. The RAM 82 is used to store data representing the number of copies desired, the magnification at which to copy information, and other items of data required in copying information. The ROM 84 stores the data representing the initializing sequence of the copying machine 2 and other items o data representing similar control sequences. The buffer memory 86 is used for storing the data representing the operation history of the machine, i.e., the number of copies made to this date, the amount of developer used thus far, the position of the paper cassette selected, and the lamp voltage applied to a lamp regulator (later described). The time counter 88 is used for measuring continously-operating time c for which the copying machine 2 has been operated continuously.

The input circuit 92 and the output circuit 94 are connected to the CPU 90.

The density sensor 72 and the temperature/humidity sensor 74 are coupled to the input circuit 92. The density sensor 72 is a photoelectric element (e.g., CdS or a photo transistor) for detecting the base density d1 of a document D and the optical density d2 of any image formed on the document D. The temperature/humidity sensor 74 is designed to detect the temperature t and humidity h within the copying machine 2.

The condition-optimizing circuit 100 is connected to the output circuit 94. The circuit 100 includes a lamp regulator 104 for driving an illumination amp 22 (later described) so that light having an optimal density can be applied to the document D. It further includes a charge generator and a bias-voltage controller. The charge generator drives a main charging device (later described). The bias-voltage controller controls a bias voltage used in a developing device (later described) thereby to control the application of toner from the developing device.

The copying machine 2 includes various sensors and switches connected to the input circuit 92. Among these are: a paper-empty switch for detecting paper sheets P remaining in the selected cassette; a toner-empty sensor for detecting the amount of toner T remaining in a developing device.

The copying machine 2 further includes a motor driver and a heater controller, which are connected to the output circuit 94. The motor driver drives motors (later described). The heater controller controls a fixing heater (later described).

The control panel 18, which will be described in detail later, is connected to an interface (not shown) which in turn is coupled to the CPU 90.

Figure 2:
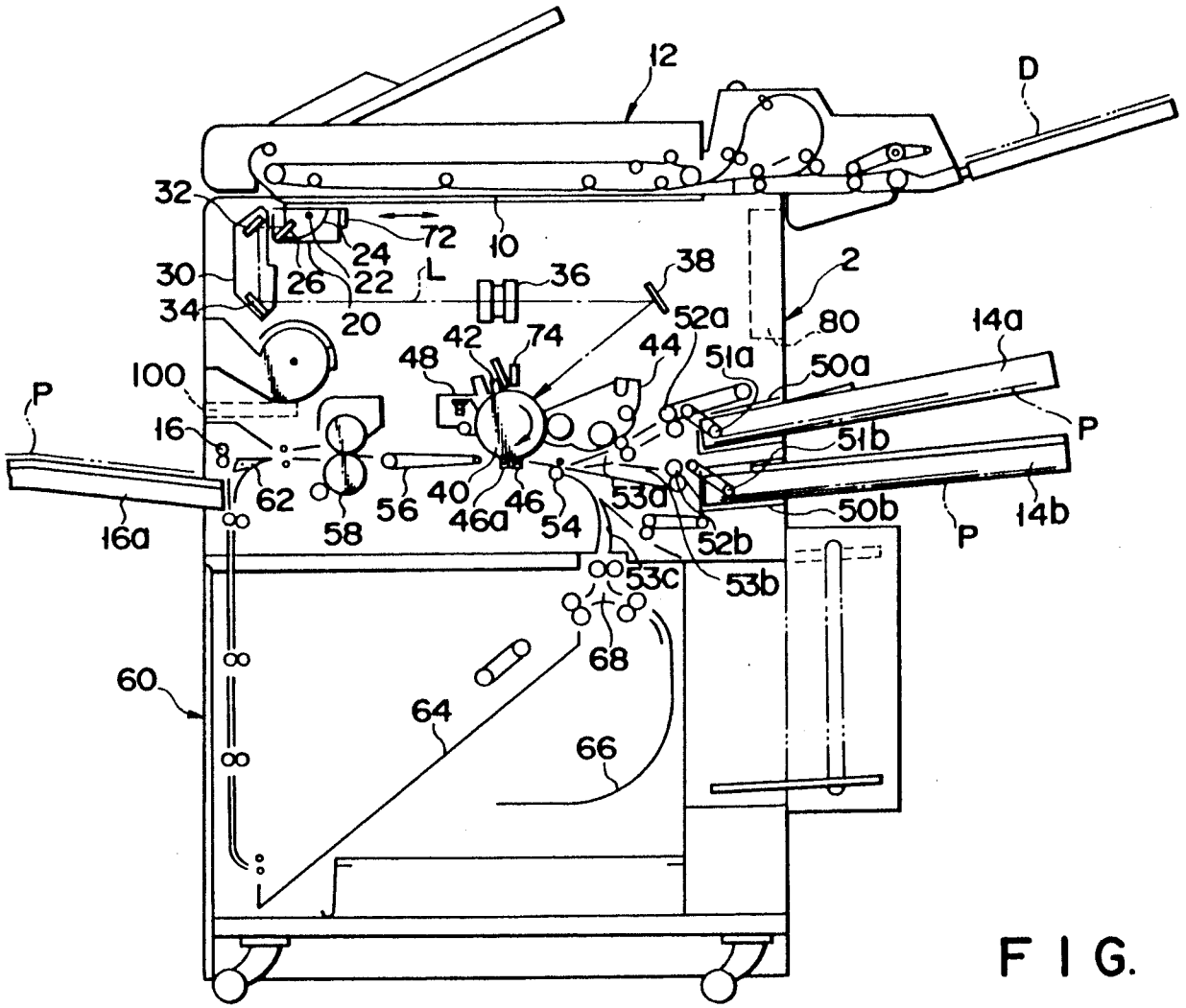
FIG. 2 is a sectional side view of the copying machine shown in FIG. 1.

As is illustrated in FIG. 2, the copying machine 2 has a document table 10 and a return auto document feeder 12 (hereinafter called "RADF"). The document table 10 supports a document D from which copies are to be made. The RADF 12 is mounted on the table 10 and hinged to one side thereof, and can therefore be moved between a closed position and an opened position. It is designed to feed the document D from a tray onto the document table 10.

Two carriages 20 and 30 are located below the document table 10. The first carriage 20 is connected to a pulse motor (not shown) by a toothed belt or a wire, and is moved back and forth, in parallel to the document table 10, when driven by the pulse motor. The carriage 20 has a lamp 22, a reflector 24, a primary mirror 26, and the density sensor 72. The lamp 22 applies light to a document D mounted on the document table 10, thus illuminating the document D. The reflector 24 reflects and focuses the light emitted from the lamp 22, and supplies the light to the document D. The primary mirror 26 receives the light beam L reflected from the document D and reflects it to the second carriage 30. As has been described, the density sensor 72 detects the base density d1 of a document D and the optical density d2 of any image formed on the document D.

The second carriage 30 is connected to the toothed belt or wire for driving the first carriage 20. Hence, it is moved when the first carriage 20 is driven, in the same direction as the first carriage 20 and at substantially half the speed the first carriage 20 moves. The second carriage 30 has a secondary mirror 32 and a tertiary mirror 34. The secondary mirror 32 reflects the light beam L from the primary mirror 26 and supplies it to the tertiary mirror 34. The tertiary mirror 34 reflects the light beam L and supplies it to a lens 36.

Both the first carriage 20 and the second carriage 30 extend in a first direction. The first direction is at right angle to a second direction in which both carriages are moved. Hereinafter, the first direction and the second direction will be referred to as "main scanning direction" and "sub-scanning direction," respectively.

A lens 36 and a holding mirror 38 are located below the first carriage 20 and on the axis of the horizontal light beam L reflected by the tertiary mirror 34. The lens 36 can be moved by drive means (not shown) back and forth along the axis of the horizontal light beam L, thereby to focus the beam L and to magnify or reduce the image of the document D. The folding mirror 38 can be moved, too, by a drive mechanism (not shown) along the axis of the horizontal light beam L, thereby to correct the fluctuation of the focal length of the lens 36, which as been caused by the motion of the lens 36. The mirror 38 reflects the light beam L and supplies it to the photoconductor 40, thereby to form an electrostatic latent image on the photoconductor 40. The electrostatic latent image is a charge-distribution pattern representing the characters and graphics printed on the document D mounted on the document table 10.

The photoconductor 40 is located below the folding mirror 38, or in the middle within the housing of the copying machine 2. A main charging device 42, the temperature/humidity sensor 74, a developing device 44, a transferring unit 46, and a cleaning unit 48 are arranged around the photoconductor 40. The main charging device 42 applies a predetermined electric charge to the photoconductor 40. As has been described, the sensor 74 detects the temperature t and humidity h within the copying machine 2. The developing device 44 applies toner to the photoconductor 40, in order to convert the latent image to a visible image or a toner image. The transferring unit 46 is designed to transfer the toner image from the photoconductor 40 onto a sheet of paper P which has been supplied by means of a material delivering system (later described). The unit 46 has an AC charge generating-section **46*a* for releasing the paper sheet P from the photoconductor 40 after the toner image has been transferred to the paper P. The cleaning unit 48 electrically discharges the photoconductor 40, thereby to change the charge-distribution pattern back to an initial one, and also scrape the residual toner from the photoconductor 40**.

The copying machine 2 has two slots **50*a* and 50*b* in the front side. Paper cassettes 14*a* and 14*b* are partly inserted into these slots 50*a* and 50*b***, respectively. Either cassette contains a stack of plain paper sheets P or OHP sheets.

In the housing of the machine 2, two feed-rollers **51*a* and 51*b*, two pairs of transporting rollers 52*a* and 52*b*, three paper-feeding paths 53*a*, 53*b* and 53*c*, and a pair of timing rollers 54 are arranged between slots 50*a* and 50*b* (the cassettes 14*a* and 14*b*), on the one hand, and the photoconductor 40**, on the other.

The first feed-roller **51*a* contacts the uppermost paper sheet P in the cassette 14*a*, and feeds this paper P from the cassette 14*a* toward the photoconductor 40 when it is rotated by a drive means (not shown). Similarly, the second feed-roller 51*b* contacts the uppermost paper P in the cassette 14*b*, and feeds this paper sheet P from the cassette 14*b* toward the photoconductor 40** when it is rotated by a drive means (not shown, either).

The first transporting rollers **52*a* are located between the first feed-roller 51*a* and the paper-feeding path 53*b*. They transports the paper P from the first feed-roller 51 toward the photoconductor 40. The second transporting rollers 52*b* are located the second feed-rollers 51*b*. The rollers 52*b* transports the paper P from the second feed-roller 51*b***.

The paper-feeding paths **53*a*, 53*b*, and 53*c* has a pair of guide plates each. The first path 53*a* guides the paper P from the first transporting rollers 52*a* toward the photoconductor 40. The second path 53*b* guides the paper P from the second transporting rollers 52*b* toward the photoconductor 40. The third path 53*c* guides a copied paper P toward the photoconductor 40, said copied paper P having been fed from the photoconductor 40 through a pedestal 60** (later described).

The timing rollers 54 correct a skew of the paper sheet P supplied through the first path **53*a*, the second path 53*b*, or the third path 53*c*, such that the leading edge of the paper sheet P is aligned with the leading edge of the toner image has been formed on the photoconductor 40 when the paper P reaches the photoconductor 40. These rollers 54 feed the paper P to the photoconductor 40 at the same speed as the circumferential speed of the photoconductor 40**.

A pair of exit rollers 16, a transporting unit 56, a fixing unit 58, a sorting gate 62 are arranged also within the housing of the copying machine 2. The transporting unit 56 feeds a paper sheet P, which has the toner image transferred to it electrostatically, from the photoconductor 40 to the fixing u it 58. The fixing unit 58 heats and melts the toner on the paper P, thereby fixing the image on the paper P (i.e., to make a hard copy). The exit rollers 16 feed the copied paper (or the hard copy) P from the housing of the copying machine 2. The sorting gate 62 is located between the exit rollers 16, on the one hand, and the fixing unit 58, for guiding the copied paper P either toward the exit rollers 16 or into the pedestal 60.

A tray **16*a* is attached to the end-portion of the housing of the copying machine 2, for receiving copied papers P fed by the exit rollers 16** out of the housing.

The pedestal 60 is a box-like component, on which the housing is mounted. The pedestal 60 contains a paper-returning mechanism for feeding copied papers P supplied from the fixing unit 58 through the sorting gate 62, to be drawn back to the photoconductor 40, so that another image if formed on the reverse side of each copied paper P or superimposed on the image already formed on the paper P. The paper-returning mechanism has a paper-feeding path 64, a paper-reversing guide 66, and a selecting-gate 68. The path 64 guides a copied paper P toward the third path **53*c*. The guide 66 is located at the exit end of the paper-feeding path 64, and turns the paper P up-side down so that an image can be formed on the reverse side of the paper sheet P. The selecting-gate 68 guides the copied paper P to either the third path 53*d* or the paper-reversing guide 66**.

Figure 3:
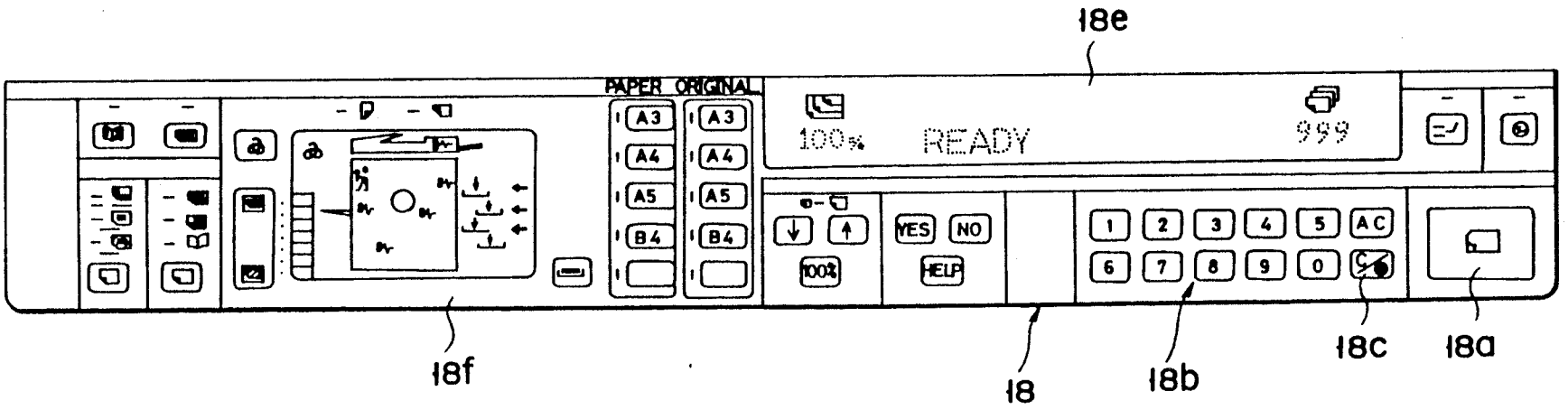
FIG. 3 is a plan view of the control panel of the copying machine illustrated in FIG. 1.

The the control panel 18 is mounted on the cover (not shown) which surrounds the document table 10. As is shown in FIG. 3, the panel 18 includes various keys. Among these keys are: a print key **18*a*, a numeral key pad 18*b*, a clear key 18*c*, an all-clear key 18*d*. When depressed, the print key 18***a* generates a print-starting signal. When selectively pushed, the keys of the numeral key pad 18*b* generate data representing a desired number of copies to make, or other kind of data. When operated, the clear key 18*c* generates a print-stopping signal or cancel any data input by operating the numeral key pad 18*b*. When depressed, the all-clear key 18*d* generates a signal for stopping all operations of the copying machine 2 and for canceling all copying modes, set by operating the panel 18, back to the copying modes initially set by the manufacturer.

The control panel 18 further includes a liquid-crystal display (LCD) 18*e* and a monitor LED display 18*f*. The LCD 18*e* is designed to display various items of input data (e.g., the desired number of copies, the copy magnification, both set by the operator), and also various messages (e.g., instructions to the operator, the timing of replenishing paper and toner, and error messages). The monitor LED display 18*f* is designed to display what condition the machine 2 is in, which cassette has been selected, and where paper-jamming, if any, is occurring.

It will now be explained how the copying machine 2 performs an image-forming process, i.e., a copying operation.

The document D supplied by the RADF 12 is mounted on the document table 10. Thereafter, the operator operates the control panel 18, thereby input various items of copying conditions such as the desired number of copies and the copy magnification. Then, the operator pushes the print key 18*a*, thus inputting a copy-start signal.

The lamp regulator 104 of the condition-optimizing circuit 100 applies a reference voltage Vre to the illumination lamp 22. The lamp 22 thereby emits light L. The reflector 24 reflects the light L, thereby illuminating the document D. The lamp regulator 104 applies a lamp voltage V to the illumination lamp 22. As has been described, this voltage V is set in accordance with the base density d1 of the document D and the optical density d2 of the image formed on the document D, both detected by the density sensor 72.

More specifically, the density sensor 72 detects the light L reflected from the document D, i.e., the image information representing the base density d1 of the document D and the optical density d2 of the image formed on the document D, and supplies the light L to the condition-optimizing circuit 100. Needless to say, the illumination lamp 22 is turned on, only while the first carriage 20 is being moved forward in the subscanning direction in order to read the information from the document D.

The condition-optimizing circuit 100 functions, not only to optimize the intensity of light for illuminating the document D, but also to optimize the conditions for forming images on the photoconductor 40. As is known in the art, as the temperature t and humidity h in the housing of the copying machine 2 increase, the electric charge on the surface of the photoconductor 40 decreases. Ultimately, the density of the image copied by the machine 2 will be low. To prevent the producing of copied images which are less dense than desired, the control unit 80 controls the charge generator and the bias-voltage controller in accordance with the temperature t and the humidity h. Thus controlled, the charge generator outputs an optimal charging voltage, and an optimal developing-bias voltage.

The illumination lamp 22, which is mounted on the first carriage 20, moves in the lengthwise direction of the document D, that is, in the sub-scanning direction, as the first carriage 20 is moved in the same direction. While being moved so, the lamp 22 illuminates the entire document D with the light L whose intensity corresponds to the reference voltage Vre. Hence, the light reflected from every part of the document D is applied to the density sensor 72 which is also mounted on the first carriage 20. This helps to enhance the accuracy of detecting the base density d1 of the document D and the optical density d2 of the image formed thereon. The data representing the densities d1 and d2, thus detected and sufficiently accurate, and the temperature t and humidity h detected by the sensor 74, supplied to the CPU 90 via the input circuit 92. The CPU 90 controls the lamp regulator 104, the charge generator, and the bias-voltage controller. As a result, the images can be formed on the photoconductor 40 under the best conditions possible.

Figure 4:
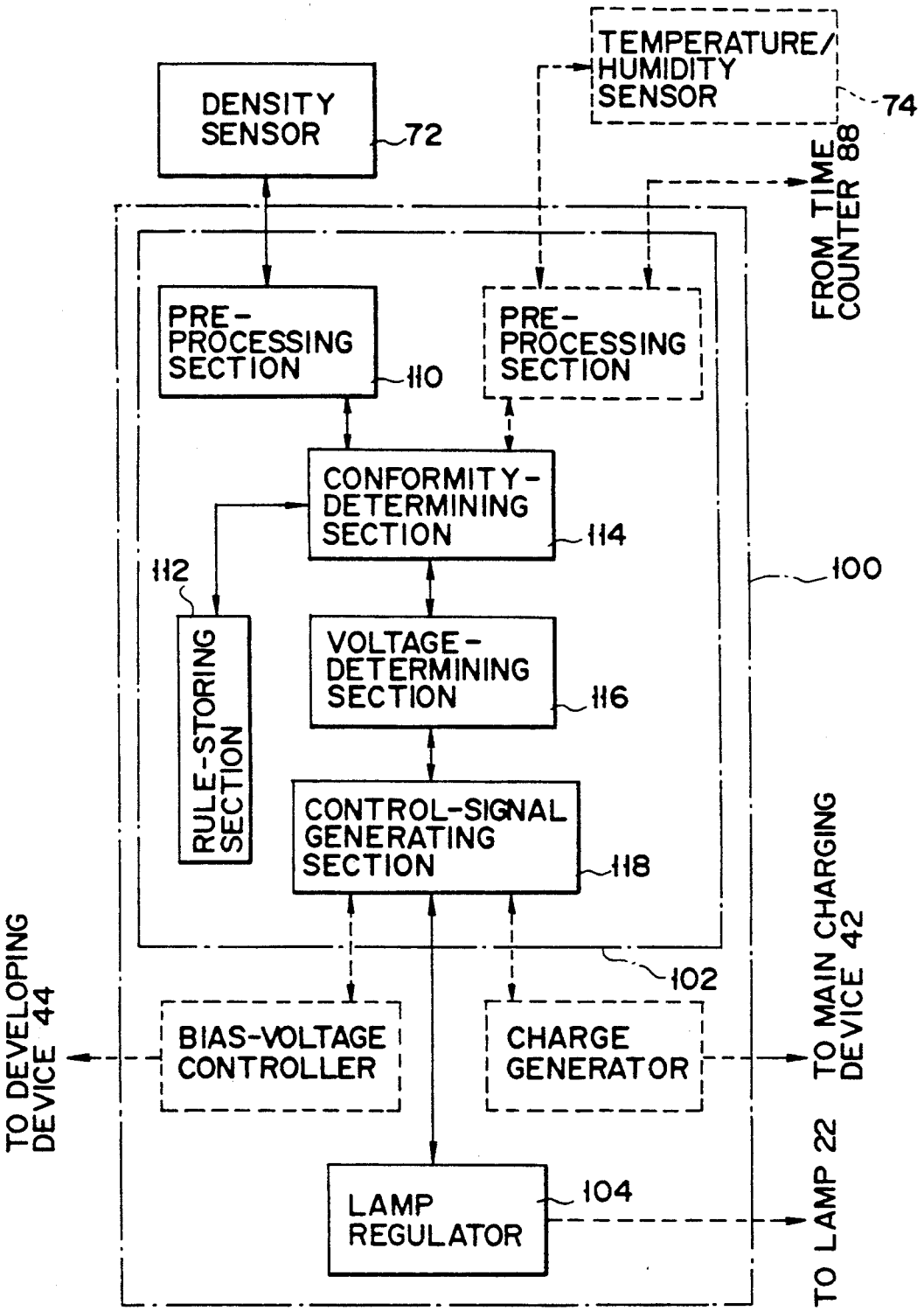
FIG. 4 is a block diagram showing the circuit incorporated in the copying machine to determine the optimal intensity of document-illuminating light.

As is illustrated in FIG. 4, the condition-optimizing circuit 100 includes a light-intensity optimizing unit 102, besides the lamp regulator 104, the charge generator and the bias-voltage controller. The unit 102 has a pre-processing section 110, a rule-storing section 112, and a conformity-determining section 114. The pre-processing section 110 determines the highest (D1max,bright) and lowest (D1min,bright) degrees of brightness and the highest (D1max,dark) and lowest (D1min,dark) degrees of darkness from the base density (i.e., first density) d1 and also of the optical density (i.e., second density) d2 of the document D. That is, the pre-processing section also determines the highest (D2max,bright) and lowest (D2min, bright) of brightness and the highest (D2max,dark) and lowest (D2min,dark) of darkness from the optical density d2. Thereafter it, obtains the difference between the highest and lowest degrees of brightness (D1max,bright−D1min,bright and D2max-,bright−D2min,bright) and the difference between the highest and lowest degrees of darkness (D1max,-dark−D1min,dark and D2max,dark−D2min,dark), and normalizes these four differences obtained. The rule-storing section 112 stores data representing various rules of controlling the voltage applied to the lamp 22 in accordance with the differences obtained and normalized by the pre-processing section 110. The conformity-determining section 114 selects, based on the normalized differences, one of the voltage-controlling rules which shows the d1,d2 relation most similar to the relation between the normalized differences.

Figures 5A, 5B, 5C, 5D:
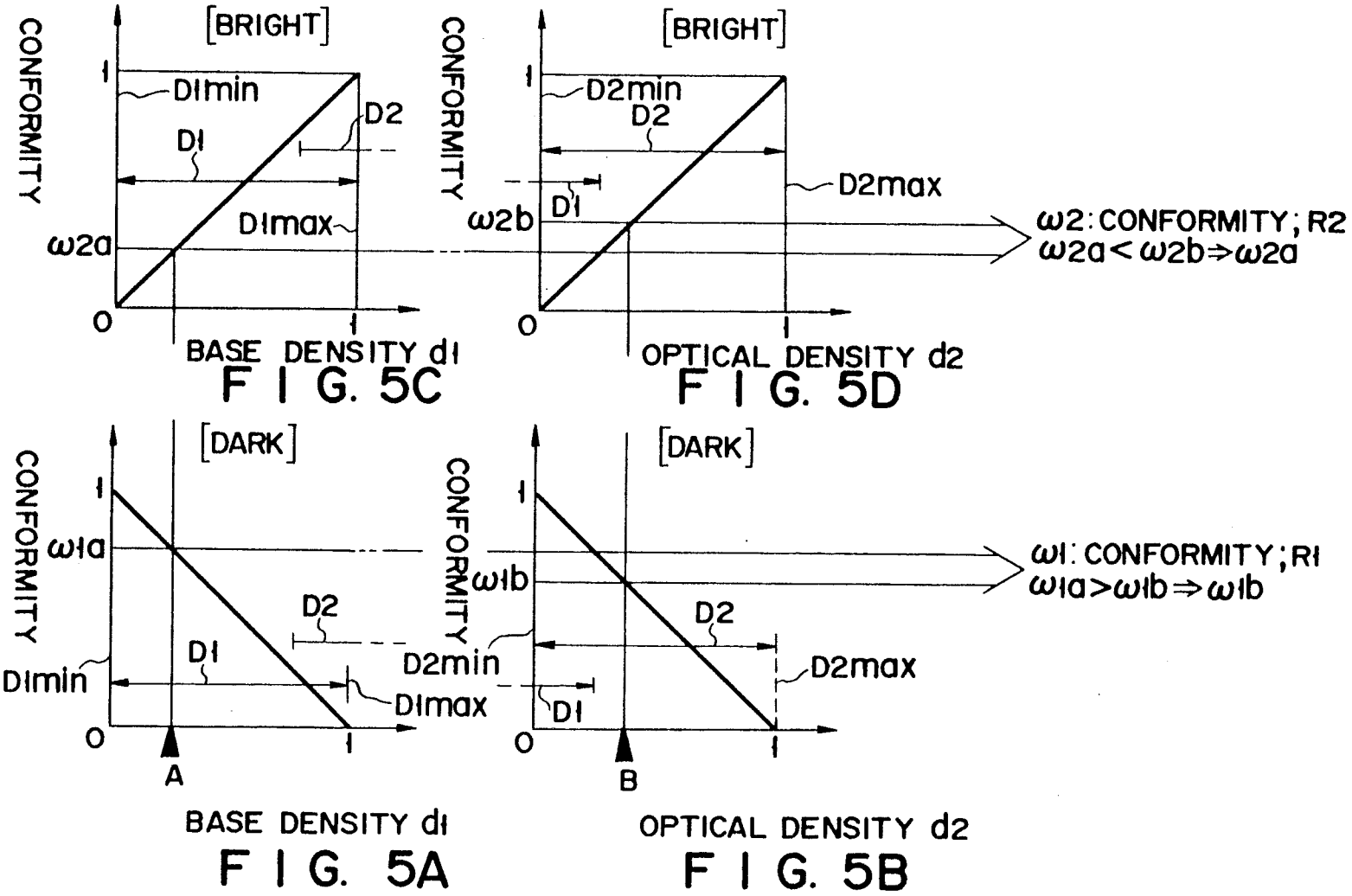
FIGS. 5A to 5D are graphs explaining how the circuit in FIG. 4 determines the optimal value for the intensity of the document-illuminating light.
Figure 5E:
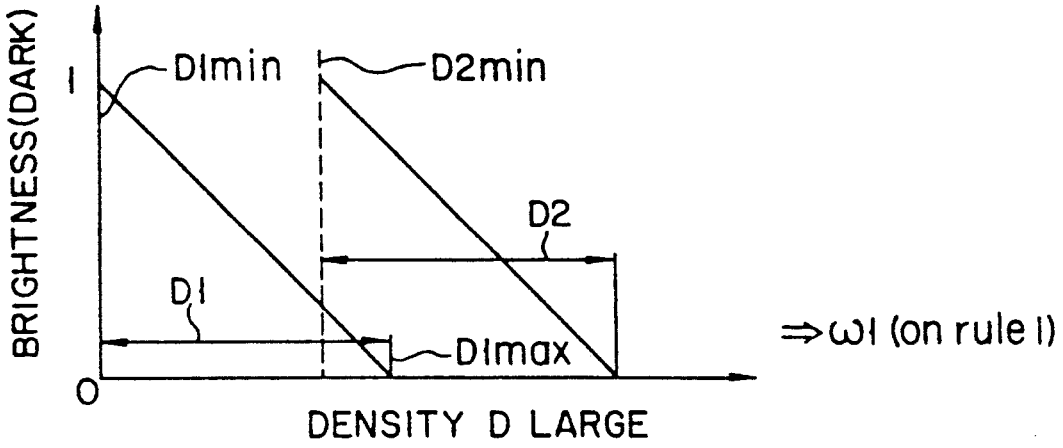
FIGS. 5E and 5F show FIGS. 5A and 5B, along with FIGS. 5C and 5D, respectively, in a different scale in a single graph.
Figure 5F:
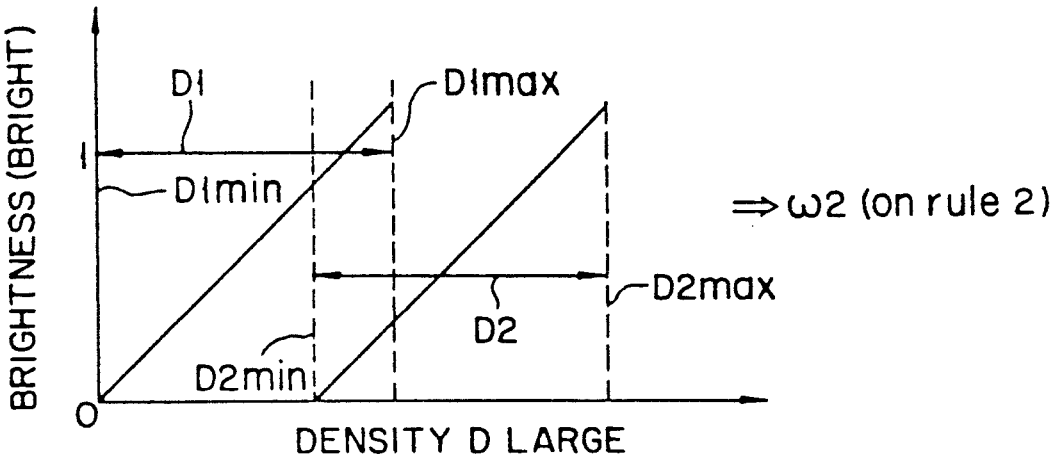
Figure 6A:
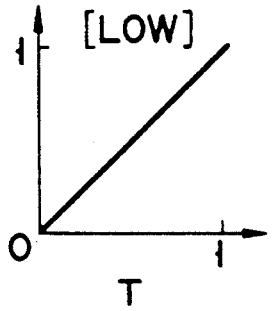
FIGS. 6A to 6L are graphs explaining how the circuit in FIG. 4 determines the optimal value for the image forming condition, in accordance with various parameters.
Figure 6B:
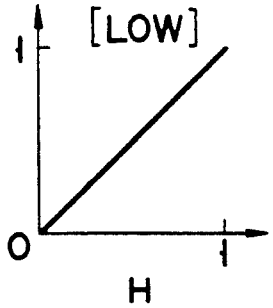
Figure 6C:
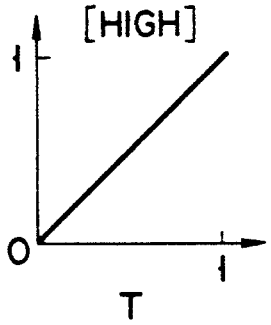
Figure 6D:
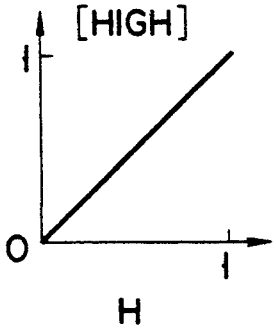
Figure 6E:
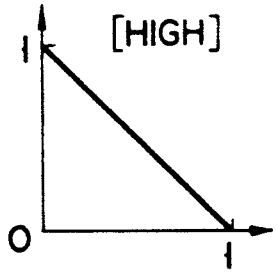
Figure 6F:
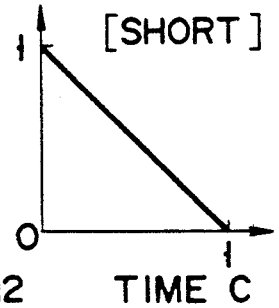
Figures 6G, 6H:
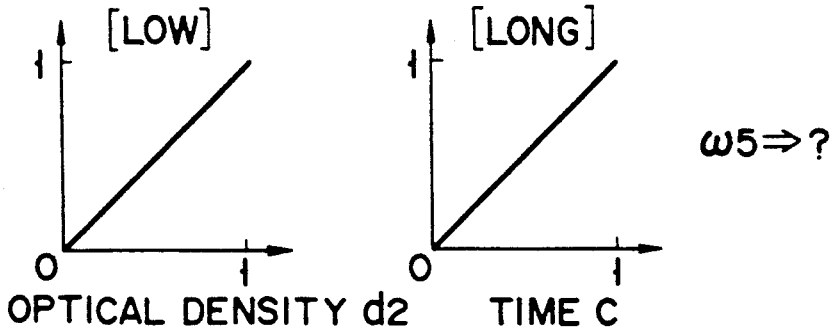
Figures 6I, 6J:
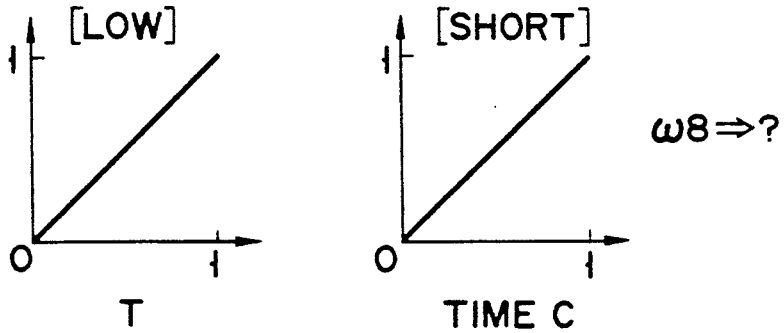
Figures 6K, 6L:
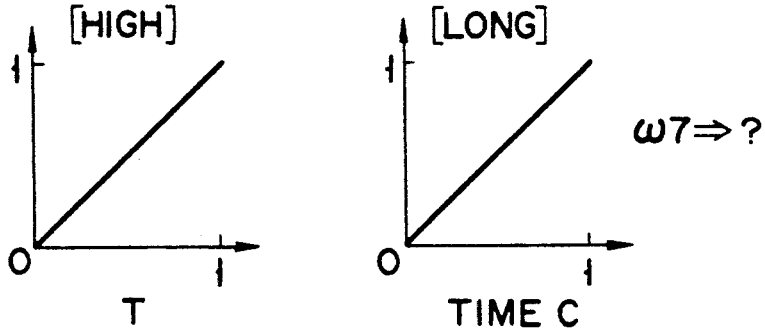

The base density d1 usually falls within the density area shown in FIG. 5A or the density area shown in FIG. 5C, generally identified as first density area D1. Similarly, the optical density d2 usually falls within the density area shown in FIG. 5B or the density area shown in FIG. 5D, generally identified as second density area D2. The first density area D1 depends on the absolute value of the base density d1, and the second density area D2 depends on the absolute value of the optical density d2. By changing the scale of the horizontal axis, the graphs shown in FIGS. 5A and 5B can be combined into a single graph. This is shown in FIG. 5'. Similarly, the graph shown in FIGS. 5C and 5D can be combined into a single graph by appropriately drawing the scale of the horizontal axis. This is shown as FIG. 5''. It can be seen, therefore, that the density areas D1 and D2 overlap.

The light-intensity optimizing unit 102 further comprises a control-value determining section 116 connected to the conformity-determining section 114, and a control-signal generating section 118 connected to the section 116. The control-value determining section 116 determines the degree of conformity between the control rule selected by the section 114 and the difference between the highest and lowest brightness (obtained and normalized by the section 110) and also the degree of conformity between the selected control value and the difference between the highest and lowest brightness (obtained and normalized by the section 110). The control-signal generating section 118 obtains a weighted means of the degrees of conformity which have been determined by the control-value determining section 116, and determines the voltage to be applied to the lamp 22, based on the weighted means.

The control rules Rn stored in the rule-storing section 112 are as follows:

R1: If both densities d1 and d2 are high, increase the intensity of the light L.

R2: If both densities d1 and d2 are low, decrease the intensity of the light L.

R3: If both the temperature t and the humidity h are low, increase the bias voltage applied to the developing device 44.

R4: If both the temperature t and the humidity h are high, increase the power supplied to the main charging device 42.

R5: If the density d2 is high, and time time c is long, increase the intensity of the light L.

R6: If the density d2 is low, and time time c is short, decrease the intensity of the light L.

R7: If the temperature t is low, and the time c is short, increase the bias voltage applied to the developing device 44.

R8: If the temperature t is high, and the time c is long, increase the power supplied to the main charging device 42.

It will now be described how the pre-processing section 110 normalizes the base density d1 and the optical density d2, with reference to FIGS. 5A to 5D. The section 110 normalizes the base density d1 at horizontal-axis coordinate A in the graph of FIG. 5A in accordance with the control rule R1, and at horizontal-axis coordinate A in the graph of FIG. 5C in accordance with the control rule R2. Also, the section 110 normalizes the optical density d2 at horizontal-axis coordinate B in the graph of FIG. 5B in accordance with the control rule R1, and at horizontal-axis coordinate B in the graph of FIG. 5D in accordance with the control rule R2.

The optimal amount of light emitted from the lamp 22 is defied as follows. The pre-processing section 110 determines where the base density d1 and the optical density d2 are positioned in the density areas D1 and D2, respectively. The density d1 is represented by the difference between D1min and D1max, whereas the density d2 is represented by the difference between D2min and D2max. In other words, the density d1 is normalized on the scale wherein the maximum density is "1", and the minimum density is "0." Here, the minimum density "0" and the maximum density "1" mean that the ground of the document D is dark and bright, respectively. The density d2 is normalized on the scale herein the maximum density is "1", and the minimum density is "0." Here, the maximum density "1" means the optical density of the darkest image that can be formed on the document D, and the minimum density "0" means the optical density of the brightest image that can be formed on the document D. The difference between D1max,dark and D1min,dark or D2max,dark and D2min,dark which the section 110 obtains, indicates a degree o darkness, and the difference between D1max,bright and D1min,bright or D2max,bright and D2min,bright, which the section 110 provides, indicates a degree of brightness.

The conformity-determining section 114 determines how much the normalized values conform to the various control rules stored in the rule-storing section 112, thereby determining the conformity $\omega$ of each normalized value. The conformity is obtained by comparing the normalized value with the conformity function (later described) prepared for each control rule based on the empirical data (make reference to FIGS. 5A to 5D). The normalized "brightness" and "darkness" densities d1 and d2 are each compared with two or more conformity functions, thus obtaining two or more conformities $\omega$, and most lower conformity is selected for the density.

In FIGS. 5A to 5F, it will be explained how the section 114 determines the conformities $\omega$ of the " darkness" and the "brightness" with respect to the control rules R1 and R2 only, for the same of simplicity. The conformity $\omega 1a$ of the "darkness" d1 with respect to the control rule R1 is greater than that $\omega 1b$ of the "brightness" with respect to the control rule R1. Namely, $\omega 1a > \omega 1b$. The conformity $\omega 2a$ of the "darkness" with respect to the control rule R2 is less than that $\omega 2b$ of the "brightness" with respect to the control rule R2. Namely, $\omega 1a < \omega 1b$. Hence, the conformities $\omega 1b$ and $\omega 2b$ are used as conformities $\omega 1$ and $\omega 2$, respectively.

The section 114 uses the data items representing the temperature t and the humidity h detected by the temperature/humidity sensor 74 and also the data item representing the continously-operating time c measured by the time counter 88, for which the copying machine 2 has been operated continuously. These data items are input to a pre-processing section (not shown) and are normalized by this pre-processing section As can be understood from FIGS. 6A to 6M, the section 114 determines the conformities $\omega 3$ to $\omega 8$ of the temperature t, the humidity h, and the continuously operating time c with respect to the control rules R3 and R8, in the same way as the conformities $\omega 1$ and $\omega 2$ of the "darkness" and "brightness." More precisely, this section normalizes the temperature t in accordance with the normalizing scale wherein the highest and lowest temperatures at which the photoconductor 40 can perform its function have the value of "0" and the value of "1", respectively. Similarly, the section normalizes the humidity h in accordance with the normalizing scale wherein the highest and lowest humidities at which the photoconductor 40 can perform its function have the value of "0" and the value of "1", respectively. Also, the section normalizes the continously-operating time c in accordance with the normalizing scale wherein the time the machine 2 operates to produce a single copy, without increasing the temperature t in the housing, has the value of "1", and the time (usually one hour) the machine 2 continuously operates to produce copies successively, saturating the temperature rise in the housing, has the value of "0." The data items representing the temperature t, the humidity h, and the time c, all normalized, are input to the conformity-determining section 114. The conformities $\omega 3$ to $\omega 8$, thus obtained, are input to a voltage-determining section different from the section 116 (which is, for example, a part of the CPU 90). Needless to say, the conformities ω5 and ω6 can be input to the control-value determining section 116, along with the conformities ω1 and ω2.

The control-value determining section 116 determines the voltage, i.e., one of the control value, to be applied to the lamp 22 (hereinafter referred to as "lamp voltage V"), from the conformities ω1*b* and ω2*b* supplied from the conformity-determining section 114. More specifically, the section 116 compares the conformities ω1*b* and ω2*b* with the voltage-determining functions predetermined based on empirical data, and determines the lamp voltage V which is one of the control values, as will be explained with reference to FIGS. 7A and 7B.

Figure 7A:
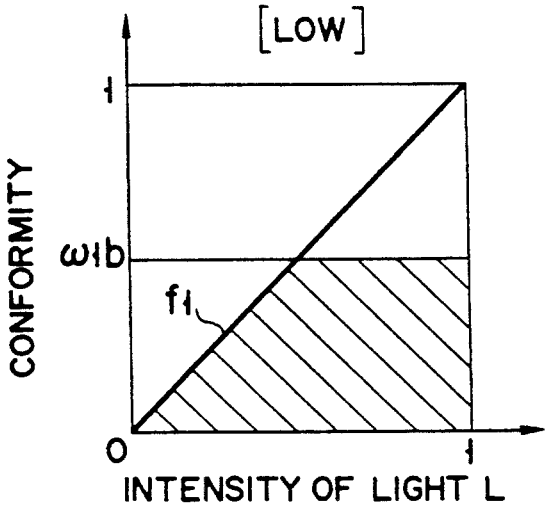
FIGS. 7A and 7B are graphs explaining the process of determining the values by which to control the image forming section of the machine, from the optimal value determined by the process explained with reference to FIGS. 5A to 5D.
Figure 7B:
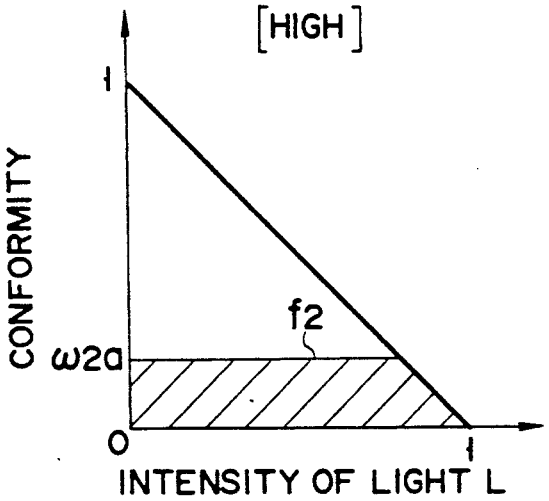

The lamp voltage V which is determined from the conformity ω1*b* in accordance with the rule R1 is the region f1 indicated by hatching in FIG. 7A. On the other hand, the lamp voltage V which is determined from the conformity ω2*a* in accordance with the rule R2 is the region f2 indicated by hatching in FIG. 7B.

The control-value determining section 116 determines other control values from the conformities ω3 to ω8 of t, h, and c with respect to the control rules R3 to R8, in the same way as the lamp voltage V.

The control values (including the lamp voltages f1 and f2) are input to the control-signal generating section 118. The section 118 determines three weighted means and outputs three signals for controlling the lamp 22, the main charging device 42, and the developing device 44, respectively.

Figure 8:
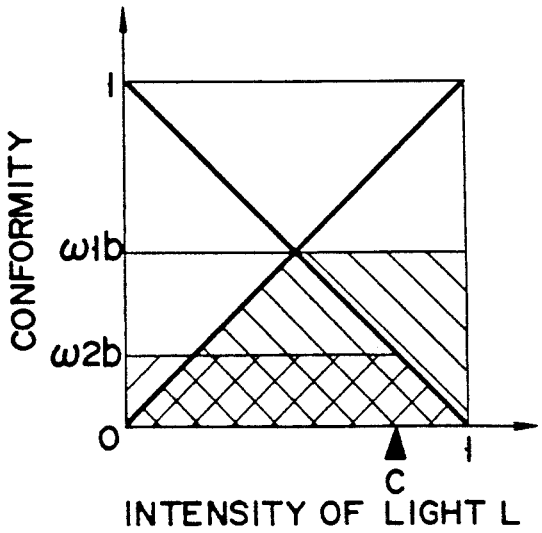
FIG. 8 is a graph explaining the process of finding a weighted mean from the control values obtained by the process explained with reference to FIGS. 7A and 7B.

To be more specific, section 118 determines the lamp voltage V in the following manner. The lamp voltage f1 (FIG. 7A) and the lamp voltage f2 FIG. 7B) are superposed, thereby determining the weighted mean of these voltages f1 and f2, which fall in the cross-hatched region in FIG. 8. Further, this weighted mean is superposed with the two other lamp voltages (not shown) obtained from the conformities ω5 and ω6 determined with respect to the rules R5 and R6 are superposed as is shown in FIG. 8, whereby the lamp voltage V is determined. This lamp voltage V is set at point C (FIG. 8) and is slightly higher than the mean value. The second 118 generates a lamp control signal corresponding to the lamp voltage V and supplies this signal to the lamp regulator 104. In response to this control signal, the lamp regulator 104 applies the lamp voltage V to the illumination lamp 22.

Figure 9:
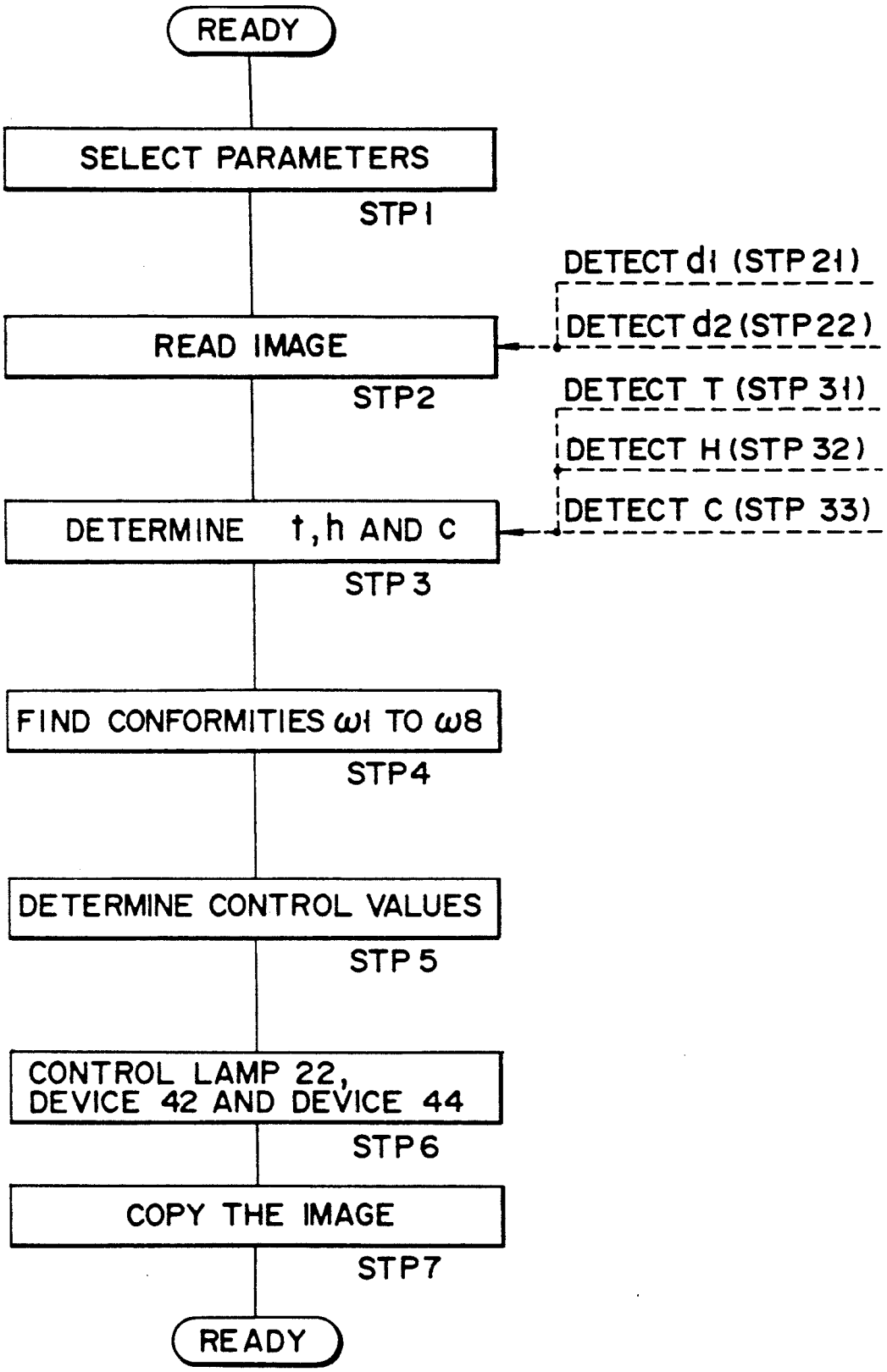
FIG. 9 is a flow chart explaining how the circuit of FIG. 4 performs its function.

With reference to the flow chart of FIG. 9, it will be explained how the condition-optimizing circuit 100 operates to determine the control values, and how the copying machine 2 produces copies of the image formed on the document D.

First, in step STP1, parameters are selected which will be used to optimize the image-forming process. In step STP2, the image formed on the document D is read. In step STP3, the various physical quantities necessary for determining the image-forming condition are detected. More specifically, the base density d1 of the document D, the optical density d2 of the image, the temperature t, the humidity h, and the time c are detected in steps STP21, STP22, STP31, STP32, and STP33, respectively. Then, in step STP4, the conformities ω1 to ω8—all defined above—are determined. In step STP5, the control values are determined from these conformities ω1 to ω8. In step STP6, the lamp 22, the main charging device 42, and the developing device 44 are controlled in accordance with the control values obtained in step STP5. In step STP7, the copying machine 2 produces a copy of the image formed on the document D after the condition-optimizing circuit 100 has thus optimized the intensity of the light L, the charge applied on the photoconductor 40, and the bias voltage applied to the developing device 44.

More specifically, the machine 2 produces the copy in the following way.

The light L from the illumination lamp 22 is applied to the document D. The light L reflected from the document D is applied to the primary mirror 26. The primary mirror 26 reflects the light L to the second ary mirror 32 of the second carriage 30. The secondary mirror 32 reflects the light L at the angle of 90° and applies it to the tertiary mirror 34. The tertiary mirror 34 reflects the light, also at the angle of 90°, and applies it to the lens 36 located at such a position that it can magnify or reduce the image of the document 10 at the desired ratio set by the operator. The light L from the lens 36 is reflected by the folding mirror 38 and supplied to that surface of the photoconductor 40 which has been electrically charged. As a result, the image of the document 10 is recorded on the photoconductor 40, in the form of an electrostatic latent image, i.e., a specific distribution of electrostatic charge.

As the first carriage 20 and the second carriage 30 are moved at the predetermined speed in the sub-scanning direction, the light L reflected from the document D is continuously applied to the photoconductor 40. Hence, the whole image on the document D is recorded, in the form of a latent image, on the photoconductor 40. Unless the magnification set by the operator is 100%, the speed of the pulse motor (not shown) is changed in accordance with the magnification, to move both carriages 20 and 30 in the sub-scanning direction.

As the photoconductor 40 is rotated, the latent image is moved toward an area to contact the developing device 44. The device 44 applies toner onto the surface of the photoconductor 40, thus developing the latent image into a visible image or a toner image.

In the meantime, the cassette 14*a* or the cassette 14*b* is selected in accordance with the size of the document D mounted on the document table 10 and the magnification set by the operator. A drive device (not shown) drives the feed-roller 51*a* or 51*b*, whereby the uppermost paper sheet P in the selected cassette is supplied to the image-transfer region provided between the photoconductor 40 and the transferring unit 46. More precisely, the paper P drawn from the cassette 14*a* or 14*b* is fed forward by the transporting rollers 52*a* or 52*b* and guided through the path 53*a* or 53*b* to the image-transfer region. The timing rollers 54 stops the paper P temporarily, correcting the skew of the paper P, such that the leading edge of the paper P is aligned with the leading edge of the image formed on the photo conductor 40 when the paper sheet P reaches the photoconductor 40. Then, the rollers 54 feed the paper P to the photoconductor 40 at the same speed as the circumferential speed of the photoconductor 40.

The paper P, now with its leading edge aligned with the leading edge of the image, is attracted onto the photoconductor 40 due to the residual electrostatic charge thereon. As the photoconductor 40 rotates, the paper P passes through the image-transfer region. At this time, the transferring unit 46 applies an electric charge to the photoconductor 40, which is of the same polarity as the charge applied to the photoconductor 40 for forming the latent image. As a result, the toner is attracted from the photoconductor 40 onto the paper P, whereby the toner image is transferred to the paper P. As a same time, an AC voltage generates from the AC charge generating section 46*a* is supplied to the paper P in a back-side. The paper P is thereby released from the photoconductor 40. The transporting unit 56 feeds the paper P from the photoconductor 40 to the fixing unit 58. The fixing unit 58, which has been heated to a temperature high enough to melt the toner. Hence, the toner on the paper P, melts, partly soaking into the paper sheet P and partly remaining on the paper P.

The paper sheet P, with the image of the document D formed on it, is fed onto the tray 16*a*, with its copied side turned up.

If the copying machine 2 is set to double-sided copying mode or multi-staged copying mode, the paper P is returned to the pedestal 60 through the sorting gate 62. In the pedestal 60, the paper sheet P is turned up-side down, or rotated by 180°, and is guided to the timing rollers 54 through the third paper-feeding path 53*c*, so that another image is formed on it.

After each toner image has been transferred from the photoconductor 40 onto a paper sheet P, the cleaning unit 48 removes the residual toner from the photoconductor 40 as the photoconductor 40 is further rotated. Then, a discharging lamp (not shown) is turned on, thus electrically discharging the photoconductor 40. As a result, the charge-distribution pattern on the photoconductor 40 is changed back to an initial one. This, the photoconductor 40 is thus made ready for forming another image.

In the embodiment described above, three control values (i.e., the lamp voltage V, the charging power, and the bias voltage) are determined from eight conformities $\omega 1$ to $\omega 8$ determined by five physical quantities (d1, d2, t, h, and c) in accordance with eight rules R1 to R8. Instead, more control values can be determined from more conformities determined by more physical quantities in accordance with more rules, thereby to control more components of the copying machine 2 so that the machine 2 may produce copies of higher quality. To mention one instance, a CCD sensor can be used in place of the density sensor 72, thereby not only detecting the densities d1 and d2, but also determining whether he image formed on the document D consists of characters only or not. If YES, the bias voltage applied to the developing device 44 is increased. If NOT because the image consists of characters and graphics, the bias voltages is decreased, thus improving the contrast of the copied image.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An image forming apparatus comprising:

means for reading an original image which is on an original document, the original having a first area having a predetermined first bright and second dark density range and a second area having a predetermined first bright and second dark density range;

means for forming an image on an image bearing member in accordance with the original image read by the reading means;

means for detecting a first density corresponding to the first area including the upper and lower limits of first bright and second dark density ranges and a second density corresponding to the second area including the upper and lower limits of first bright and second dark density ranges in the original image;

first judging means for judging an operation condition in which the image forming means is to form an image of the first area of the original, from the difference between the first area's upper and lower limit of the first density range's bright area and the difference between the first area's upper and lower limit of the second density range's dark area;

second judging means for judging an operation condition in which the image forming means is to form an image of the second area of the original, from the difference between the second area's lower and upper limits of the first density range's bright area and the difference between the second area's lower and upper limits of the second density range's dark area;

determining means for determining an operating condition in which said image forming means is to be operated, from the operating condition judged by the first judging means and the operating condition judged by the second judging means; and means for controlling the image forming means in accordance with the operating condition determined by the determining means.

2. An image forming apparatus comprising:

means for reading an original image which is on an original document, the original having a first area having a predetermined first bright and second dark density range and a second area having a predetermined first bright and second dark density range;

means for forming an image on an image bearing member in accordance with the original image read by the reading means;

means for detecting a first density corresponding to the first area including upper and lower limits of first bright and second dark density ranges and a second density corresponding to the second area including upper and lower limits of first bright and second dark density ranges in the original image;

first judging means for judging an operation condition in which the image forming means is to form an image of the first area of the original, from the difference between the first area's upper and lower limit of the first density range's bright area and the difference between the first area's upper and lower limit of the second density range's dark area;

second judging means for judging an operation condition in which the image forming means is to form an image of the second area of the original, from the difference between a second area's first density value and the second area's upper limit of the first density range's dark area and the difference between a second area's second density value and the second areas upper limit of the second density ranges' bright area;

determining means for determining an operating condition in which said image forming means is to be operated, from the operating condition judged by the first judging means and the operation condition judged by the second judging means; and means for controlling the image forming means in accordance with the operating condition determined by the determining means.

3. An image forming apparatus comprising:

means for illuminating an original document with emitted light rays, the intensity of said light rays being changeable;

means for detecting a first optical density of a first area on the original document, said first density of said first area representing a base density for the original document, the first density being determined in accordance with the highest and lowest degrees of brightness and the highest and lowest degrees of darkness measured from the base density, and a second optical density of a second area thereon, which is different from said first area, said second density being determined in accordance with the highest and lowest degrees of brightness and the highest and lowest degrees of darkness from the optical density, through the utilization of light reflected from the original document illuminated with the light rays from said illuminating means;

means for normalizing either the difference between the highest and lowest degrees of brightness of the first and second densities or the difference between the highest and lowest degrees of darkness of the first and second densities detected by said detecting means, in accordance with predetermined conditions;

means for controlling the intensity of the light rays from said illuminating means, in accordance with either the difference in brightness or the difference in darkness normalized by said normalizing means; and means for applying a voltage to said illuminating means in accordance with the light intensity controlled by said controlling means.

4. An apparatus according to claim 3, wherein said first area on the original document includes a region on which no image information is present.

5. An image forming apparatus comprising:

means for illuminating an original document with emitted light rays, the intensity of said light rays being changeable:

means for detecting a first optical density of a first area on the original document, including a region on which no image information is present, and a second optical density of a second area thereon, which is different from said first area, through the utilization of light reflected from the original document illuminated with the light rays from said illuminating means, the first density of said first area representing a base density for the original document, said first density being determined in accordance with the highest and lowest degrees of brightness and the highest and lowest degrees of darkness measured from the base density;

means for normalizing either the difference between the highest and lowest degrees of brightness or the difference between the highest and lowest degrees of darkness detected by said detecting means, in accordance with predetermined conditions;

means for controlling the intensity of the light rays from said illuminating means; and means for applying a voltage to said illuminating means in accordance with the light intensity controlled by said controlling means.

6. An apparatus according to claim 3, wherein said second region on the original document is a region in which image information is present.

7. An image forming apparatus comprising:

means for illuminating an original document with emitted light rays, the intensity of said light rays being changeable:

means for detecting a first optical density of a first area on the original document, and a second optical density of a second area thereon, which is different from said first area, through illuminated with the light rays from said illuminating means, the second region on the original document being a region in which image information is present, the second density being determined in accordance with the highest and lowest degrees of brightness and the highest and lowest degrees of darkness measured from the optical density;

means for normalizing either the difference between the highest and lowest degrees of brightness or the difference between the highest and lowest degrees of darkness detected by said detecting means, in accordance with predetermined conditions;

means for controlling the intensity of the light rays from said illuminating means; and means for applying a voltage to said illuminating means in accordance with the light intensity controlled by said controlling means.

* * * * *